US006673991B2

(12) United States Patent
Hara

(10) Patent No.: US 6,673,991 B2
(45) Date of Patent: Jan. 6, 2004

(54) KEYBOARD LID OPENING AND CLOSING MECHANISM FOR KEYBOARD MUSICAL INSTRUMENT AND KEYBOARD MUSICAL INSTRUMENT

(75) Inventor: Kenichiro Hara, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 10/446,516

(22) Filed: May 28, 2003

(65) Prior Publication Data

US 2003/0221537 A1 Dec. 4, 2003

(30) Foreign Application Priority Data

May 29, 2002 (JP) ..... 2002-155681

(51) Int. Cl.[7] ..... G10C 3/02

(52) U.S. Cl. ..... 84/179

(58) Field of Search ..... 84/179, 178, 177, 84/184, 186.1

(56) References Cited

U.S. PATENT DOCUMENTS 5,773,738 A * 6/1998 Chou ..... 84/600

FOREIGN PATENT DOCUMENTS

JP 2001-343976 12/2001

* cited by examiner

*Primary Examiner*—Kimberly Lockett
(74) *Attorney, Agent, or Firm*—Davis & Bujold, PLLC

(57) ABSTRACT

A keyboard lid opening and closing mechanism for a keyboard musical instrument having a simple structure and not requiring a large space for installation thereof. To house a keyboard lid in the folded state inside the keyboard musical instrument, the mechanism is provided with a reverse V-shape forming portion disposed at the place where the undersurface of the keyboard lid passes while moving, a rotation support portion including first connecting groove walls, and a keyboard lid stop portion including second connecting groove walls. Therefore, the structure of the mechanism for opening and closing the keyboard lid is simplified, and a large space for installation of the mechanism is not necessary since these portions include no movable parts.

10 Claims, 6 Drawing Sheets

KEYBOARD LID OPENING AND CLOSING MECHANISM FOR KEYBOARD MUSICAL INSTRUMENT AND KEYBOARD MUSICAL INSTRUMENT

BACKGROUND OF THE INVENTION (i) Field of the Invention

The present invention relates to a keyboard lid opening and closing mechanism for a keyboard musical instrument.

(ii) Background Art

These days, an operation panel provided in a variety of keyboard musical instruments, such as an electronic piano or an electronic organ, is becoming larger since it is required to arrange a variety of operation elements and indicators on the operation panel to realize a various types of musical performance. Therefore, a keyboard lid for covering such a large operation panel and a keyboard is also required to be accordingly large.

In a conventional keyboard musical instrument, a large keyboard lid covering a keyboard and an operation panel is removed from over the keyboard and the operation panel, and is housed inside the keyboard musical instrument during a musical performance by a player. Usually, removing a keyboard lid covering a keyboard and an operation panel from over the keyboard and the operation panel is referred to as "opening a keyboard lid," while covering a keyboard and an operation panel with a keyboard lid is referred to as "closing a keyboard lid." Therefore, the term "opening and closing of a keyboard lid" is used herein with the meaning as described above.

When a large keyboard lid as above is formed with a single plate-like member, the depth of the keyboard musical instrument must be large.

Accordingly, in some conventional keyboard musical instruments as mentioned above, the keyboard lid is formed by connecting a plurality of plate-like members, such as a primary lid and a secondary lid, with a hinge or the like, and is folded at the connecting portion so as to be housed inside the keyboard musical instrument, so that the overall size of the keyboard musical instrument may be reduced. For example, the keyboard lid opening and closing mechanism for a keyboard musical instrument disclosed in Publication of Unexamined Japanese Patent Application No. 2001-343976, comprises a retention mechanism provided with a first arm member which is rotatably held by a base fixed to the inside surface of an arm and a second arm member which is rotatably held in a coaxial manner with respect to the first arm member and is designed to operate in conjunction with the first arm member.

The retention mechanism operates as follows. In the opening operation of the keyboard lid, when the keyboard lid is moved to the inside of the body of the keyboard musical instrument, the keyboard lid abuts the first arm member.

When the keyboard lid is further moved, the first arm member is pressed by the keyboard lid and starts rotating. Then, the second arm member starts rotating in conjunction with the first arm member, and the end portion of the second arm member lifts up the keyboard lid from thereunder. As the result of the operation of the second arm member, the keyboard lid is folded at the section connected by the hinge.

When the keyboard lid is further moved, the keyboard lid in the folded state is housed inside the body of the keyboard musical instrument.

However, the above described keyboard lid opening and closing mechanism has a complex structure and requires a large space for installation thereof since the mechanism includes rotating members.

An object of the present invention, which has been made to solve the above problems involved in the prior art, is to provide a keyboard lid opening and closing mechanism for a keyboard musical instrument which has a simple structure and does not require a large space for installation thereof.

SUMMARY OF THE INVENTION

The above and other objects are attained by a keyboard lid opening and closing mechanism for a keyboard musical instrument which comprises a keyboard lid including a front lid for covering over a keyboard placed between arms arranged opposite to each other in the vicinity of the front left and right ends of the keyboard musical instrument, and a rear lid having a front end connected with the rear end of the front lid by a connecting portion in a foldable manner into a reverse V-shape, the keyboard lid being movable between a position of covering over the keyboard (lid closed position) and a position of being housed inside the keyboard musical instrument (lid open position); and a keyboard lid guide portion for guiding the keyboard lid between the lid closed position and the lid open position. The keyboard lid opening and closing mechanism further comprises a reverse V-shape forming portion for folding the keyboard lid moving from the lid closed position to the lid open position into a reverse V-shape configuration at the connecting portion, a rotation support portion for supporting the rear lid of the keyboard lid folded into a reverse V-shape configuration at the connecting portion by the reverse V-shape forming portion when the keyboard lid moves from the lid closed position to the lid open position, thereby rotating the rear lid around the support portion, and a keyboard lid stop portion for stopping the keyboard lid while moving in the lid open position.

According to the present keyboard lid opening and closing mechanism for a keyboard musical instrument, the keyboard lid in the lid closed position is moved toward the lid open position to open the keyboard lid covering over the keyboard for a musical performance. Specifically, the keyboard lid is moved toward the inside of the body of the keyboard musical instrument by, for example, pushing the front lid. The keyboard lid is guided by the keyboard lid guide portion between the lid closed position and the lid open position. Then, the keyboard lid while moving is folded into a reverse V-shape configuration at the connecting portion by the reverse V-shape forming portion. In this case, the reverse V-shape forming portion may be disposed at the place through which the undersurface of the keyboard lid while moving passes in a contact manner with the reverse. V-shape forming portion. Subsequently, the rotation support portion supports the rear lid of the keyboard lid folded into a reverse V-shape configuration. Then, the front end of the rear lid is pushed in a different direction from the direction toward the rear end of the rear lid, and the rear lid starts to rotate around the support portion, and thereby the keyboard lid becomes folded further. Finally, the keyboard lid stop portion stops the keyboard lid in the lid open position to house the keyboard lid in the folded state within the body of the keyboard musical instrument. The keyboard lid stop portion is designed to stop the front lid while moving.

On the other hand, to close the keyboard lid after the musical performance, the keyboard lid in the lid open position is moved toward the lid closed position.

Specifically, the keyboard lid housed in the folded state inside the body of the keyboard musical instrument is moved toward over the keyboard by, for example, pulling the front lid over the keyboard. Then, the keyboard lid detaches from the keyboard lid stop portion, while the rear lid rotates in the opposite direction to the direction of opening the keyboard lid. During this process, the reverse V-shape formed by the keyboard lid gradually becomes flat. Subsequently, the rear lid detaches the rotation support portion, and the keyboard lid is pulled out from the body of the keyboard musical instrument. Thus, the keyboard lid covers over the keyboard in the lid closed position.

As described above, to house a keyboard lid in the folded state inside the keyboard musical instrument, only the reverse V-shape forming portion, the rotation support portion and the keyboard lid stop portion are necessary. Therefore, the structure of the mechanism for opening and closing the keyboard lid is simplified, and a large space for installation of the mechanism is not necessary since these portions include no movable parts.

A keyboard musical instrument of some type has an inclined operation panel provided obliquely above and behind the keyboard. In such a keyboard musical instrument, the keyboard lid in the lid closed position covers over the operation panel as well as over the keyboard.

The above described keyboard lid guide portion may be designed to guide the rear lid in the obliquely downward direction when the keyboard lid moves from the lid closed position to the lid open position, thereby to enable rotation of the rear lid in a compact space. In this case, the depth of the space for housing the keyboard lid may be reduced compared with the case of guiding the keyboard lid in an approximately horizontal direction rearward inside the body of the keyboard musical instrument. Thus, the depth of the body of the keyboard musical instrument may be accordingly reduced.

In another aspect of the invention, there is provided a keyboard lid opening and closing mechanism for a keyboard musical instrument, wherein the rear lid is provided with rear lid projections extending in the lateral direction of the rear lid, and wherein the keyboard lid guide portion is provided with a lower groove wall and an upper groove wall approximately parallel with each other, the lower groove wall supporting the keyboard lid from thereunder through the rear lid projections when the rear lid moves between the lid closed position and the lid open position, and the upper groove wall preventing the keyboard lid from coming off to the upward direction through the rear lid projections when the rear lid moves between the lid closed position and the lid open position. This enables stabilized movement of the keyboard lid.

In this case, the rotation support portion includes the vicinity of the rear end of the lower groove wall, and a connecting groove wall connecting the rear end of the lower groove wall and the rear end of the upper groove wall. When the keyboard lid moves from the lid closed position to the lid open position, the rear lid projections of the rear lid abut the vicinity of the rear ends of the lower groove walls and the connecting groove walls, and the rear lid rotates around the rear lid projections. Therefore, the rear lid may be rotated smoothly.

The movement of the keyboard lid may be further stabilized according to the following keyboard lid opening and closing mechanism. In the mechanism, the front lid is provided with the front lid projections, and when the front lid moves between the lid closed position and the lid open position, the lower groove wall retains the front lid from thereunder through the front lid projection, while the upper groove wall prevents the front lid from coming off toward the upper direction through the front lid projections.

In a further aspect of the invention, there is provided a keyboard lid opening and closing mechanism for a keyboard musical instrument, wherein there are at least two rear lid projections, two of which extend coaxially toward opposite directions, and wherein there are at least two keyboard lid guide portions, two of which guide the coaxial two rear lid projections, respectively. With this mechanism, the position and the movement of the keyboard lid may be stabilized since the keyboard lid guide portions support and guide the keyboard lid from at least both sides of the keyboard lid.

In this case, easy attachment and detachment of the keyboard lid to and from the body of the keyboard musical instrument is facilitated when at least one of the coaxial two rear lid projections is configured to be extendable.

To attach the rear lid to the body of the keyboard musical instrument, an extendable one of the two coaxial rear lid projections is first shortened, and then the rear lid is moved such that the rear lid projections are positioned between the keyboard lid guide portions for guiding the rear lid projections, respectively. Then, the shortened rear lid projection is extended so as to make these rear lid projections be inserted between the two rear lid guide portions. By this, the keyboard lid is attached to the body of the keyboard musical instrument.

On the other hand, to detach the keyboard lid from the body of the keyboard musical instrument, an extendable rear lid projection is first shortened. This enables the two coaxial rear lid projections to be moved from between the two keyboard lid guide portions, and thus enables the rear lid to be detached from the body of the keyboard musical instrument.

In the event that the keyboard lid is not pushed straight when being housed inside the body of the keyboard musical instrument, forces of the same strength will not imposed on the both ends of the guide shaft, so that the keyboard lid may not be moved smoothly due to idling or slip of one of the both ends.

In a further aspect of the invention, there is provided a keyboard lid opening and closing mechanism for a keyboard musical instrument, wherein the keyboard lid is provided with a rotatable guide shaft having respective pinion gears in the vicinity of both ends thereof and disposed along a direction perpendicular to the moving direction thereof, and wherein a pair of racks are arranged so as to be engaged with the respective pinion gears when the keyboard lid moves between the lid closed position and the lid open position. This mechanism, in which the pinion gears at the both ends of the guide shaft and the racks are engaged with each other, will not cause the above mentioned idling or slip, so that the movement of the keyboard lid may be further stabilized.

In this case, a guide shaft provided with the rear lid projection at both ends thereof will simplify the structure of the mechanism.

Furthermore, the keyboard lid guide portion, the rack and the reverse V-shape forming portion, which are integrally configured and are attachable/detachable to/from the arm, can be easily attached to the arm with screws and the like. This may reduce the number of assembly steps of the entire keyboard musical instrument.

BRIEF DESCRIPTION OF THE DRAWINGS

A preferred embodiment of the present invention will be described hereinafter with reference to the drawings, in which.

DETAILED DESCRIPTION OF THE PREFERRED EMBODIMENTS

Figure 1:
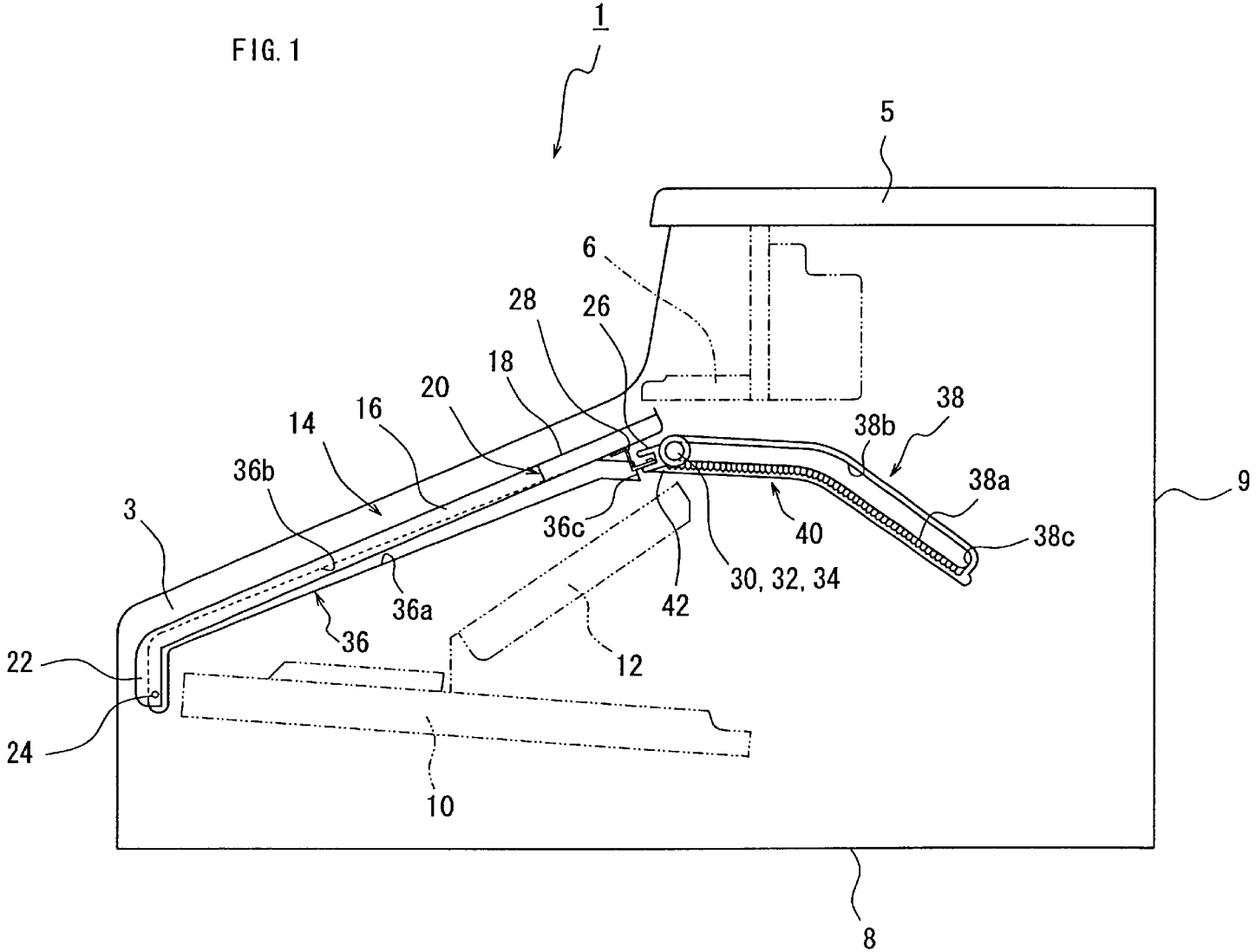
FIG. 1 is a sectional side view of a keyboard musical instrument according to the present embodiment showing a keyboard lid in a lid closed position.

FIG. 1 shows a sectional side view of a keyboard musical instrument 1 according to the present embodiment showing a keyboard lid 14 in a lid closed position. The "lid closed position" will be described hereinafter. The keyboard musical instrument 1 comprises arms 3, 3 arranged opposite to each other in the vicinity of the front left and right ends of the keyboard musical instrument 1, a top panel 5, an inside roof 6 disposed under the top panel 5, a bottom panel 8, a rear panel 9, a keyboard 10 disposed between the arms 3, 3 and an operation panel 12. The keyboard 10 including white keys and black keys is disposed in the front side between the arms 3, 3. The operation panel 12 including a variety of switches and electronic circuits is disposed obliquely above and behind the keyboard 10 so as to be upwardly inclined toward the rear panel 9.

The keyboard lid 14 according to the present invention designed to cover over the keyboard 10 and the operation panel 12 includes a plate-like front lid 16 for covering the front portion of them and a plate-like rear lid 18 for covering the rear portion of them. The rear end of the front lid 16 and the front end of the rear lid 18 are connected with a hinge 20 as a connection such that the keyboard lid 14 is folded to show a reverse V-shape configuration.

The front lid 16 is provided at the front end with a modesty panel 22 extending downward to cover the front side of the keyboard 10. Both lateral faces of the front lid 16 are provided with front lid projections 24, 24 extending respectively in the left and the right directions.

Figure 2A:
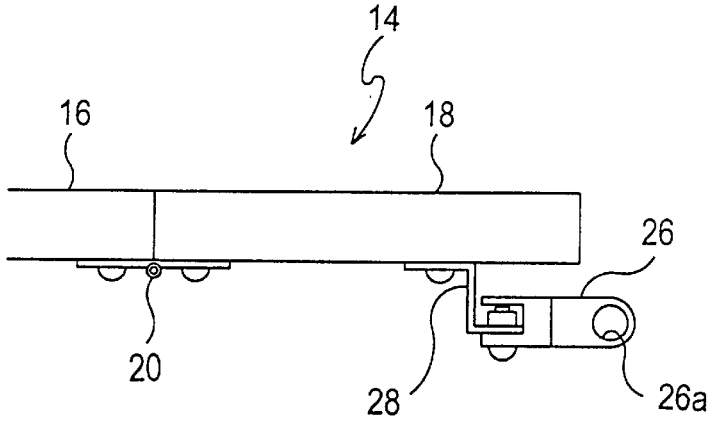
FIG. 2A is an explanatory view of a rear lid of the keyboard lid according to the present embodiment showing a keyboard lid shaft holder and a keyboard lid shaft holder fixing bracket.
Figure 2B:
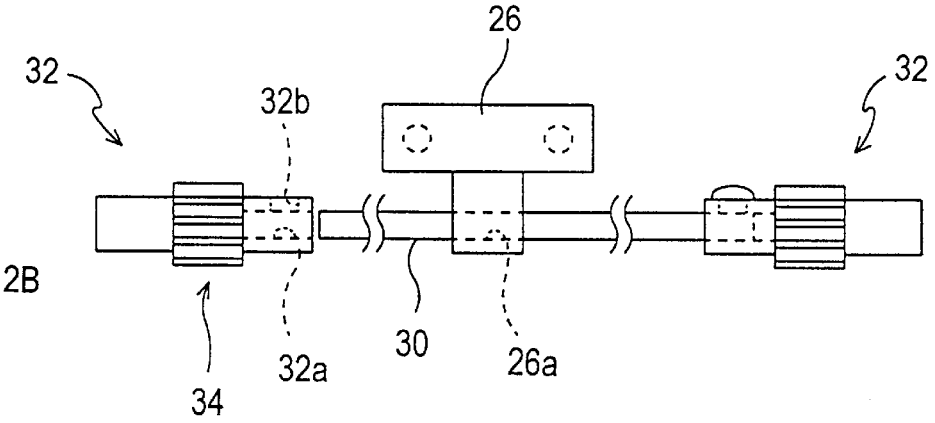
FIG. 2B is an explanatory view of the rear lid of the keyboard lid according to the present embodiment showing the keyboard lid shaft holder, a guide shaft and pinion gears.

As shown in FIG. 2A, a keyboard lid shaft holder 26 is fixed on the undersurface of the rear lid 18 through a keyboard lid shaft holder fixing bracket 28. The keyboard lid shaft holder 26 may be designed to be fixed to the rear lid 18 without using the keyboard lid shaft holder fixing bracket 28. The keyboard lid shaft holder 26 has a shaft hole 26*a* through which a guide shaft 30 is passed, as shown in FIG. 2B. The shaft hole 26*a* is configured such that the guide shaft 30 is rotatable therein. The keyboard lid shaft holder 26 and the keyboard lid shaft holder fixing bracket 28 are designed such that the guide shaft 30 is disposed along the left and right directions of the keyboard lid 14, i.e. perpendicular to the surface of FIG. 2A.

As shown in FIGS. 1 and 2B, the rear lid projections 32, 32 are attached to the both ends of the guide shaft 30. Specifically, the rear lid projection 32 has a columnar configuration with an attachment hole 32a opened from one end along the axial direction. The rear lid projection 32 also has a screw hole 32b communicating with the attachment hole 32a along the diametrical direction of the rear lid projection 32. The rear lid projection 32 also has a pinion gear 34 provided along the circumferential direction thereof.

To attach the rear lid projection 32 to the guide shaft 30, one end of the guide shaft 30 (the left end in FIG. 2B) is first inserted into the attachment hole 32*a* of the left rear lid projection 32. Then, a not shown screw is screwed into a screw hole 32*b* and is tightened until the screw presses against the circumference of the guide shaft 30, thereby preventing the rear lid projection 32 from shifting with respect to the guide shaft 30 (see the right rear lid projection 32 in FIG. 2B). The rear lid projections 32 are attached to the both ends of the guide shaft 30, respectively, following the procedure above. To detach the rear lid projection 32 attached to the guide shaft 30, it is required to follow the reverse order of the procedure for attachment described above.

The keyboard musical instrument 1 comprises a pair of front lid guide members 36, 36 and a pair of rear lid guide members 38, 38 provided respectively on the arms 3, 3. The front lid guide members 36, 36 and the rear lid guide members 38, 38 correspond to keyboard lid guide portions.

Each of the front lid guide members 36, 36 includes a lower groove wall 36*a* and an upper groove wall 36*b* disposed in parallel with each other along the inner surface of the arm 3. The lower groove wall 36*a* and the upper groove wall 36*b* are upwardly inclined toward the rear panel 9. The respective front ends of the lower groove wall 36*a* and the upper groove wall 36*b* are interconnected through a connecting groove wall, and the respective rear ends of the lower groove wall 36*a* and the upper groove wall 36*b* are interconnected through another connecting groove wall 36*c*. The portion in which the respective rear ends of the lower groove wall 36*a* and the upper groove wall 36*b* are interconnected through the connecting groove wall 36*c* corresponds to a keyboard lid stop portion. The front lid guide members 36, 36 provided respectively with a plurality of fixing holes are fixed to the arms 3, 3, respectively, by screwing screws and the like in the fixing holes.

On the other hand, each of the rear lid guide members 38, 38 includes a lower groove wall 38*a* and an upper groove wall 38*b* disposed in parallel with each other along the inner surface of the arm 3. The lower groove wall 38*a* and the upper groove wall 38*b*, respectively, consist of approximately horizontal portions and inclined portions which are downwardly inclined toward the rear panel 9. The respective front ends of the lower groove wall 38*a* and the upper groove wall 38*b* are interconnected through a connecting groove wall, and the respective rear ends of the lower groove wall 38*a* and the upper groove wall 38*b* are interconnected through another connecting groove wall 38*c*. The vicinity of the rear end of the lower groove wall 38*a* and the connecting groove wall 38*c* correspond to a rotation support portion.

The rear lid guide member 38 includes a rack 40 and an abutting portion 42, all of which are integrally configured.

Specifically a rack 40 is provided in the lower part of the rear lid guide member 38 along the lower groove wall 38*a*. The rack 40 is designed so as to engage with the pinion gear 34 when the rear lid 18 is mounted on the rear lid guide member 38. The abutting portion 42 is provided at the front end of the rack 40. The abutting portion 42 is positioned such that when the keyboard lid 14 attached to the keyboard musical instrument 1 is moved, the undersurface of the keyboard lid 14 passes through in a contact manner with the abutting portion 42.

Since the rear lid guide member 38, particularly the upper groove wall 38*b*, is downwardly inclined toward the rear panel 9, the rear end of the rear lid 18 moving along the upper groove wall 38*b* is directed downwardly toward the rear panel 9, and thus the extent of folding of the keyboard lid 14 into a reverse V-shape configuration is accordingly increased.

The rear lid guide members 38, 38 provided respectively with a plurality of fixing holes 38*d* are fixed to the arms 3, 3, respectively, by screwing screws and the like in the fixing holes 38*d*.

Figure 6:
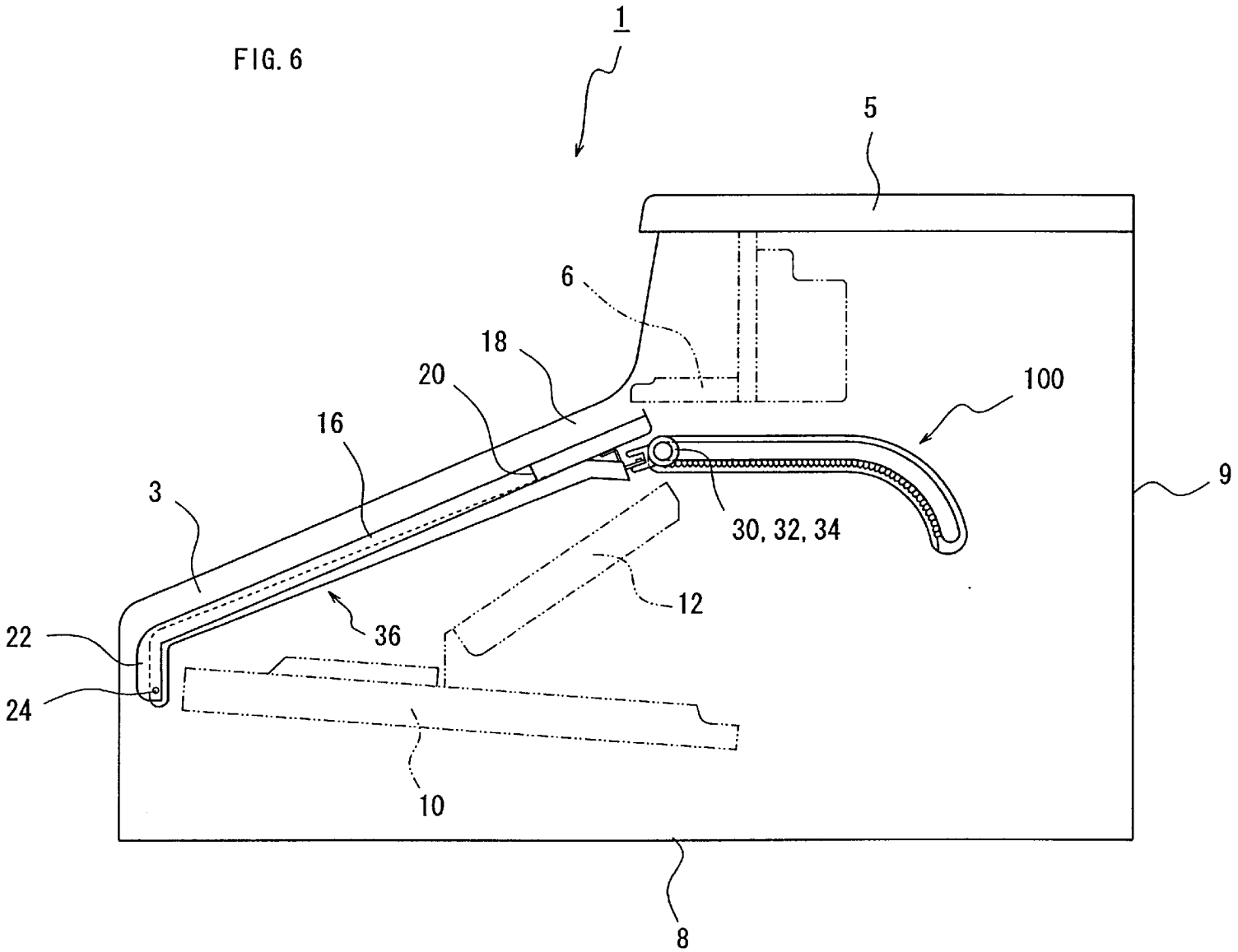
FIG. 6 is a sectional side view of the keyboard musical instrument showing another embodiment of a keyboard lid guide portion.

The configuration of the rear lid guide member 38 shown in FIG. 1 is symmetrical in the front and rear directions, and the same rear lid guide members 38 are used for the left and the right arms 3, 3. Accordingly, it is unnecessary to produce different rear lid guide members corresponding, respectively, to the left and the right arms 3, 3. It may also be possible to employ rear lid guide members having different configurations (see rear lid guide members 100, 100 in FIG. 6) corresponding, respectively, to the left and the right arms 3, 3 depending on the size and the like of the keyboard musical instrument 1.

The above described keyboard lid 14 is attached to the keyboard musical instrument 1 by being mounted on the keyboard lid guide portions (the front lid guide members 36, 36 and the rear lid guide members 38, 38) through the front lid projections 24, 24 of the front lid 16 and the rear lid projections 32, 32 of the rear lid 18.

First, as shown in FIG. 1, the front lid projections 24, 24 of the front lid 16 are inserted respectively into the front lid guide members 36, 36. Specifically, the front lid projections 24, 24 of the front lid 16 are inserted respectively between the lower groove walls 36*a* and the upper groove walls 36*b*. Each of the front lid projections 24, 24 of the front lid 16 is capable of moving from the front ends through the rear ends of the lower groove wall 36*a* and the upper groove wall 36*b*. When the front lid 16 is moved, the lower groove wall 36*a* retains the front lid 16 from thereunder through the front lid projection 24, while the upper groove wall 36*b* prevents the front lid 16 from coming off toward the upper direction through the front lid projection 24.

Figure 2C:
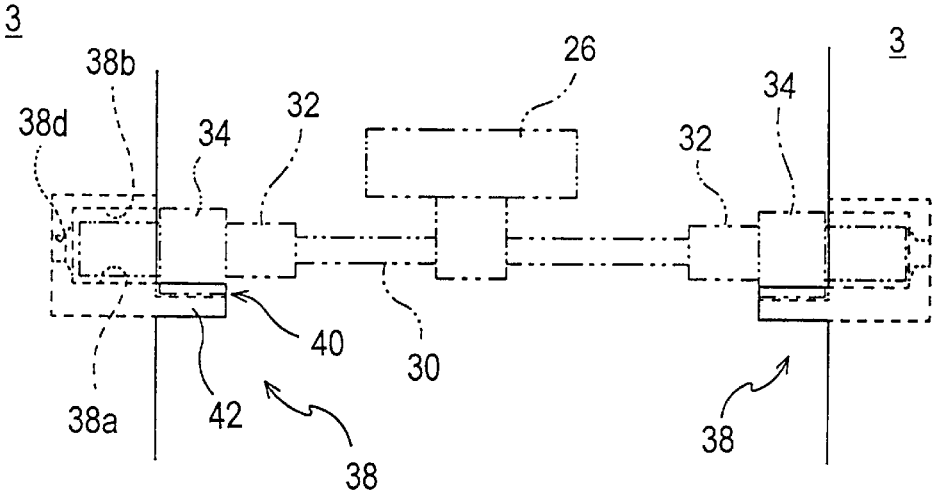
FIG. 2C is an explanatory view of the rear lid of the keyboard lid according to the present embodiment showing the rear lid in the state of being fixed to a rear lid guide member.

Then, as shown in FIG. 1, the rear lid projections 32, 32 of the rear lid 18 are inserted respectively into the rear lid guide members 38, 38. The rear lid 18 with the rear lid projections 32, 32 configured to be extendable with respect to the guide shaft 30 as described above, is attachable to and detachable from the keyboard musical instrument 1. Specifically, the both ends of the guide shaft 30 are inserted, respectively, to the ends of the attachment holes 32*b*, 32*b*. In this case, the depth of the attachment hole 32*b* and the length of the guide shaft 30 are configured such that the distance between the both ends of the rear lid projections 32, 32 is shorter than the distance between the rear lid guide members 38, 38. Subsequently, the rear lid 18 is moved such that the rear lid projections 32, 32 and the guide shaft 30 are positioned between the rear lid guide members 38, 38. Then, the rear lid projections 32, 32 are moved so as to be inserted between the lower groove walls 38*a* and the upper groove walls 38*b* of the respective rear lid guide members 38, 38. By this, the pinion gears 34, 34 of the rear lid projections 32, 32 and the racks 40, 40 of the rear lid guide members 38, 38 are engaged with each other, respectively. Subsequently, each screw is screwed into each screw hole 32*b* and tightened until the rear lid projection 32 becomes unmovable with respect to the guide shaft 30, and thus the rear lid 18 is attached to the keyboard musical instrument 1 (FIG. 2C).

Then, each of the rear lid projections 32, 32 is capable of moving from the front ends through the rear ends of the lower groove wall 38*a* and the upper groove wall 38*b* with the pinion gear 34 engaged with the rack 40. When the rear lid 18 is moved, the lower groove wall 38*a* retains the rear lid 18 from thereunder through the rear lid projection 32, while the upper groove wall 38*b* prevents the rear lid 18 from coming off toward the upper direction through the rear lid projection 32.

When the keyboard lid 14 once attached to the keyboard musical instrument 1 is moved forwardly of the keyboard musical instrument 1, the front lid projections 24, 24 abut the respective front ends of the front lid guide members 36, 36, or the rear lid projections 32, 32 abut the respective front ends of the rear lid guide members 38, 38, thereby stopping the keyboard lid 14. In this case, the keyboard lid 14 is arranged so as to be upwardly inclined toward the rear panel 9 and cover over the keyboard 10 and the operation panel 12 (lid closed position).

On the other hand, to detach the rear lid 18 attached to the keyboard musical instrument 1, it is required to follow the reverse order of the procedure for attachment described above. Specifically, the screws for fixing the rear lid projections 32, 32 to the guide shaft 30 are loosened, thereby enabling the rear lid projections 32, 32 to move in the axial direction of the guide shaft 30. Subsequently, the rear lid projections 32, 32 are moved to make the distance between the rear lid projections 32, 32 shorter than the distance between the rear lid guide members 38, 38. Then, the rear lid 18 is moved upward and detached from the keyboard musical instrument 1.

Since other structures of the keyboard musical instrument 1 are in accordance with the prior art, a detailed explanation is not repeated.

Opening and closing operation of the keyboard lid 14 will now be described below.

Figure 3:
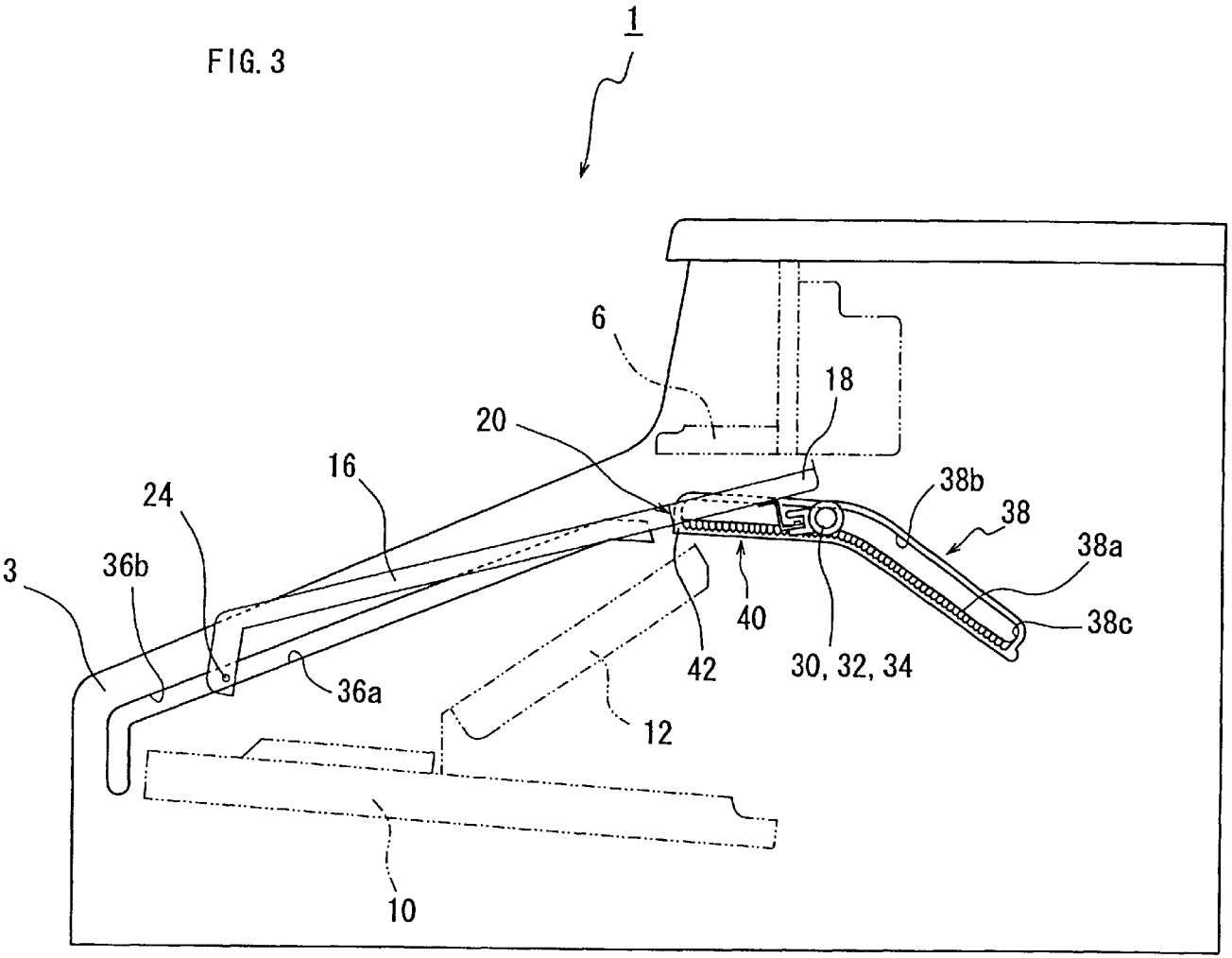
FIG. 3 is a first sectional side view of the keyboard musical instrument showing the keyboard lid moving from the lid closed position toward a lid open position.

To open the keyboard lid 14 covering over the keyboard 10 and the operation panel 12 (FIG. 1: lid closed position) for a musical performance, the keyboard lid 14 is moved toward the inside of the keyboard musical instrument 1 by, for example, pushing the front lid 16. Then, the keyboard lid 14 abuts the abutting portions 42, 42 disposed at the places through which the undersurface of the keyboard lid 14 passes in a contact manner with the abutting portions 42, 42 (FIG. 3). When the keyboard lid 14 is further moved, the keyboard lid 14 slides on the abutting portions 42, 42 and starts to be folded into a reverse V-shape configuration at the hinge 20 due to the operation of the abutting portions 42, 42.

When the keyboard lid 14 is further moved, the rear lid projections 32, 32 of the rear lid 18 reach the respective rear ends of the rear lid guide members 38, 38, and abut the respective connecting groove walls 38*c*, 38*c*.

Figure 4:
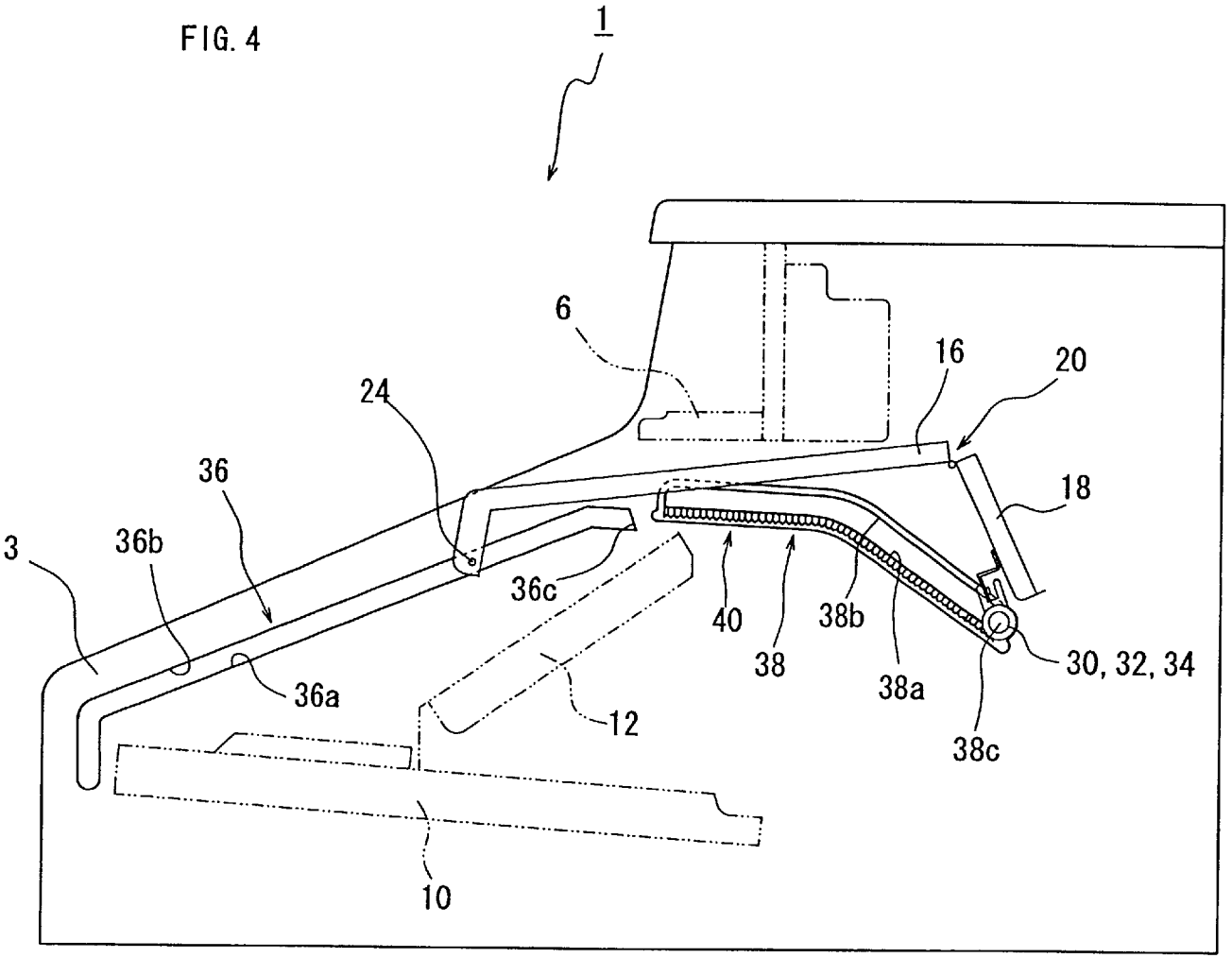
FIG. 4 is a second sectional side view of the keyboard musical instrument showing the keyboard lid moving from the lid closed position toward the lid open position.

When the keyboard lid 14 is further moved, the front end of the rear lid 18 is pushed in the different direction from the direction toward the rear end of the rear lid 18. Then, the rear lid 18 starts to rotate around the rear lid projections 32, 32 and the guide shaft 30 supported by the vicinity of the respective rear ends of the lower groove walls 38*a*, 38*a* and the connecting groove walls 38*c*, 38*c* (rotation support portion), and thereby the keyboard lid 14 becomes folded further (FIG. 4).

Figure 5:
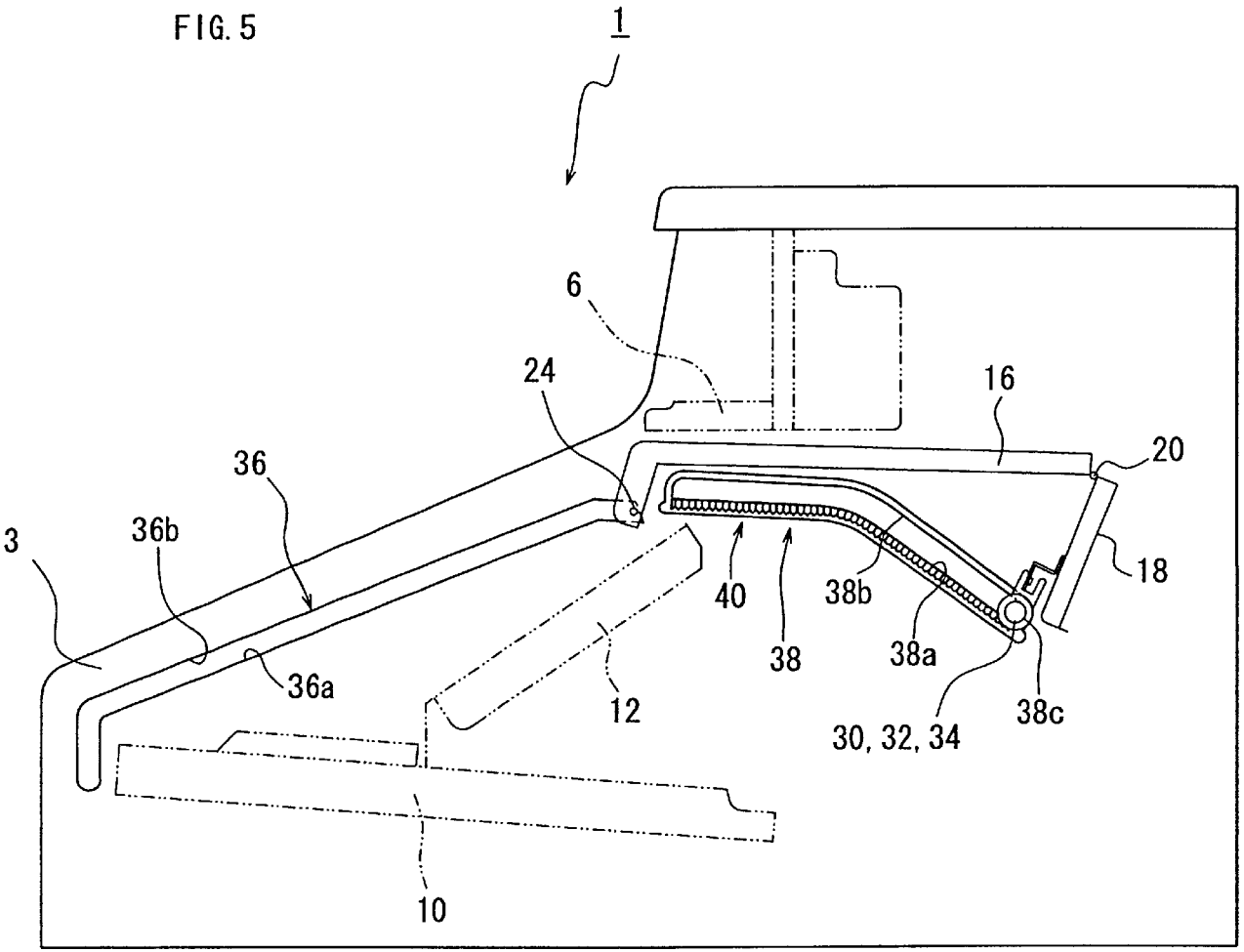
FIG. 5 is a sectional side view of the keyboard musical instrument showing the keyboard lid in the lid open position.

When the keyboard lid 14 is further moved, the front lid projections 24, 24 of the front lid 16 reach the respective rear ends of the front lid guide members 36, 36, and abut the respective connecting groove walls 36*c*, 36*c* (keyboard lid stop portion). Then, the movement of the keyboard lid 14 is stopped, which means that the rotation of the rear lid 18 is also stopped, and the keyboard lid 14 in the folded state is housed inside the keyboard musical instrument 1 (FIG. 5: lid open position).

On the other hand, to close the keyboard lid 14 after the musical performance, the keyboard lid 14 in the folded state inside the keyboard musical instrument 1 is moved over the keyboard 10 and the operation panel 12 by, for example, pulling the front lid 16. Then, the front lid projections 24, 24 of the keyboard lid 14 detach from the respective rear ends of the front lid guide members 36, 36, while the rear lid 18 rotates in the opposite direction to the direction of opening the keyboard lid 14. During this process, the reverse V-shape formed by the keyboard lid 14 gradually becomes flat.

When the keyboard lid 14 is further moved, the rear lid 18 detaches from the rear ends (rotation support portions) of the rear lid guide members 38, 38, and the keyboard lid 14 is pulled out from the inside of the keyboard musical instrument 1.

When the keyboard lid 14 is further moved, the respective front lid projections 24, 24 of the front lid 16 reach the respective front ends of the front lid guide members 36, 36. Then, the front lid 14 is stopped and covers over the keyboard 10 and the operation panel 12 (FIG. 1: lid closed position).

As described above, the keyboard musical instrument 1 according to the present invention is provided only with the reverse V-shape forming portions (the abutting portions 42 and the downwardly inclined rear lid guide member 38), the rotation support portions (the vicinity of the respective rear ends of the lower groove walls 38*a* and the connecting groove walls 38*c*) and the keyboard lid stop portions (the connecting groove walls 36*c*, 36*c*), in order to house the keyboard lid 14 in the folded state inside the keyboard musical instrument 1. This enables the structure for opening and closing the lid 14 to be simple. Also, these portions which have no movable parts do not require a large space for installation thereof.

Since the above described rear lid guide members 38, 38 guide the rear lid projections 32, 32 of the rear lid 18 moving from the lid closed position to the lid open position in a rear obliquely downward direction, respectively, it is possible to rotate the rear lid 18 within a compact space. In this case, the depth of the space to house the keyboard lid therewithin may be smaller compared with the case of guiding the keyboard lid 14 in an approximately horizontal rearward direction of the keyboard musical instrument 1. Therefore, the depth of the keyboard musical instrument 1 can be reduced.

In the case of guiding the keyboard lid 14 in an approximately horizontal rearward direction of the keyboard musical instrument 1, it is necessary to dispose the inside roof 6 at a high position so as not to obstruct the movement of the keyboard lid 14. In contrast, in the present embodiment as described above, in which the rear lid guide members 38, 38 guide the rear lid projections 32, 32 of the rear lid 18 in the rear obliquely downward direction, respectively, the fulcrum of the rotation of the rear lid 18 is located at a relatively low position, and the path of the rear lid 18 is also located at a low position. Accordingly, the inside roof 6 can be disposed at a low position, and thus the overall height of the keyboard musical instrument 1 can be reduced.

Furthermore, the rear lid projections 32, 32 respectively extendable with respect to the both ends of the guide shaft 30 facilitate easy attachment and detachment of the keyboard lid 14 to and from the keyboard musical instrument 1. It is further preferable that the front lid projections 24, 24 are extendable with respect to the front lid 16.

When the keyboard lid 14 is moved between the lid closed position and the lid open position, neither of the pinion gear 34, 34 and the racks 40, 40 respectively engaging with each other, runs idle or slips even if the keyboard lid 14 is not pushed straight. Thus, the movement of the keyboard lid 14 can be further stabilized.

OTHER EMBODIMENTS (1) While the keyboard lid 14 consists of two lid portions in the above embodiment, the keyboard lid 14 may consist of three lid portions. In this case, the keyboard lid 14 can be folded in a further compact space.

(2) While the keyboard lid 14 moving from the lid closed position to the lid open position is stopped at the lid open position by the keyboard lid stop portions, such as connecting groove walls 36*c*, 36*c* in the above embodiment, the keyboard lid 14 may be stopped at the lid open position, for example, by the connecting groove walls 38*c*, 38*c* of the rear lid guide members 38, 38.

(3) While the arms 3, 3 are provided with the recessed front lid guide members 36, 36 and rear lid guide members 38, 38, and the keyboard lid 14 is provided with the protruding front lid projections 24, 24 and rear lid projections 36, 36 in the above embodiment, a structure may be possible in which the arms 3, 3 are provided with respective protruding front lid projections and the keyboard lid 14 is provided with recessed guide members.

(4) While the pinion gears 34, 34 are provided in the vicinity of the both ends of the guide shaft and the racks 40, 40 corresponding respectively to the pinion gears 34, 34 are provided on the rear lid guide members 38, 38 in the above embodiment, another structure (e.g. a roller and a rail or a rubber material) may be employed as long as the structure can achieve the same effect as by the pinion gear 34 and the rack 40.

Although the present invention has been described with respect to the above described embodiments, the present invention should not be limited to the embodiments and various embodiments of the invention can be made without departing from the spirit and scope of the invention.

What is claimed is:

1. A keyboard lid opening and closing mechanism for a keyboard musical instrument comprising:

a keyboard lid including a front lid for covering over a keyboard placed between arms arranged opposite to each other in the vicinity of the front left and right ends of the keyboard musical instrument, and a rear lid having a front end connected with the rear end of the front lid by a connecting portion in a foldable manner into a reverse V-shape, the keyboard lid being movable between a position of covering over the keyboard (lid closed position) and a position of being housed inside the keyboard musical instrument (lid open position); and a keyboard lid guide portion for guiding the keyboard lid between the lid closed position and the lid open position, wherein the keyboard lid opening and closing mechanism further comprises:

a reverse V-shape forming portion for folding the keyboard lid moving from the lid closed position to the lid open position into a reverse V-shape configuration at the connecting portion;

a rotation support portion for supporting the rear lid of the keyboard lid folded into a reverse V-shape configuration at the connecting portion by the reverse V-shape forming portion when the keyboard lid moves from the lid closed position to the lid open position, thereby rotating the rear lid around the support portion; and a keyboard lid stop portion for stopping the keyboard lid while moving in the lid open position.

2. The keyboard lid opening and closing mechanism for a keyboard musical instrument according to claim 1, wherein the reverse V-shape forming portion is disposed at the place through which the undersurface of the keyboard lid passes when the keyboard lid moves from the lid closed position to the lid open position.

3. The keyboard lid opening and closing mechanism for a keyboard musical instrument according to claim 1, wherein the keyboard lid stop portion stops the front lid while moving thereby to stop the keyboard lid in the lid open position.

4. The keyboard lid opening and closing mechanism for a keyboard musical instrument according to claim 1, wherein the keyboard lid guide portion guides the rear lid in the rear obliquely downward direction when the keyboard lid moves from the lid closed position to the lid open position.

5. The keyboard lid opening and closing mechanism for a keyboard musical instrument according to claim 1, wherein the rear lid is provided with rear lid projections extending in the lateral direction of the rear lid, and wherein the keyboard lid guide portion is provided with a lower groove wall and an upper groove wall approximately parallel with each other, the lower groove wall supporting the keyboard lid from thereunder through the rear lid projections when the rear lid moves between the lid closed position and the lid open position, and the upper groove wall preventing the keyboard lid from coming off to the upward direction through the rear lid projections when the rear lid moves between the lid closed position and the lid open position.

6. The keyboard lid opening and closing mechanism for a keyboard musical instrument according to claim 5, wherein the rotation support portion includes the vicinity of the rear end of the lower groove wall, and a connecting groove wall connecting the rear end of the lower groove wall and the rear end of the upper groove wall.

7. The keyboard lid opening and closing mechanism for a keyboard musical instrument according to claim 5, wherein there are at least two rear lid projections, two of which extend coaxially toward opposite directions, wherein there are at least two keyboard lid guide portions, two of which guide the coaxial two rear lid projections, respectively, and wherein at least one of the coaxial two rear lid projections is configured to be extendable.

8. The keyboard lid opening and closing mechanism for a keyboard musical instrument according to claim 1, wherein the keyboard lid is provided with a rotatable guide shaft having respective pinion gears in the vicinity of both ends thereof and disposed along a direction perpendicular to the moving direction thereof, and wherein a pair of racks are arranged so as to be engaged with the respective pinion gears when the keyboard lid moves between the lid closed position and the lid open position.

9. The keyboard lid opening and closing mechanism for a keyboard musical instrument according to claim 8, wherein the keyboard lid guide portion, the rack and the reverse V-shape forming portion are integrally configured and are attachable/detachable to/from the arm.

10. A keyboard musical instrument provided with the keyboard lid opening and closing mechanism for a keyboard musical instrument according to claim 1.

* * * * *